US011752796B2

(12) United States Patent
Nishitani et al.

(10) Patent No.: US 11,752,796 B2
(45) Date of Patent: Sep. 12, 2023

(54) TAIL PLUG AND WRITING INSTRUMENT

(71) Applicant: KURETAKE CO., LTD., Nara (JP)

(72) Inventors: Ichiro Nishitani, Nara (JP); Makiko Morimoto, Nara (JP)

(73) Assignee: KURETAKE CO., LTD., Nara (JP)

( * ) Notice: Subject to any disclaimer, the term of this patent is extended or adjusted under 35 U.S.C. 154(b) by 0 days.

(21) Appl. No.: 17/825,160

(22) Filed: May 26, 2022

(65) Prior Publication Data

US 2022/0379652 A1 Dec. 1, 2022

(30) Foreign Application Priority Data

May 28, 2021 (JP) ..... 2021-090372

(51) Int. Cl.
*B43K 8/02* (2006.01)
*B43K 23/12* (2006.01)
*B43K 11/00* (2006.01)

(52) U.S. Cl.
CPC ..... *B43K 8/02* (2013.01); *B43K 11/00* (2013.01); *B43K 11/005* (2013.01); *B43K 23/122* (2013.01); *B43K 23/124* (2013.01)

(58) Field of Classification Search
CPC ..... B43K 8/02; B43K 23/122; B43K 23/124; B43K 11/00; B43K 11/005
USPC ..... 215/307, 364, 320; 401/247, 242, 245
See application file for complete search history.

(56) References Cited

U.S. PATENT DOCUMENTS

| | | | | |
|---|---|---|---|---|
| 5,888,008 | A * | 3/1999 | Obersteller | B43K 11/00 401/230 |
| 2006/0231520 | A1* | 10/2006 | Van Cromvoirt | B65D 39/12 215/361 |
| 2015/0298489 | A1* | 10/2015 | Kamitani | B43K 23/12 401/142 |
| 2017/0008330 | A1* | 1/2017 | Hui | B43K 8/003 |
| 2018/0311994 | A1* | 11/2018 | Murphy | B43K 8/04 |

FOREIGN PATENT DOCUMENTS

| | | | |
|---|---|---|---|
| JP | H0258980 | U | 4/1990 |
| JP | H10147092 | A | 6/1998 |
| JP | 2000247087 | A | 9/2000 |

* cited by examiner

*Primary Examiner* — David J Walczak
(74) *Attorney, Agent, or Firm* — THE WEBB LAW FIRM

(57) ABSTRACT

A tail plug to be attached to a tail end of a shaft part of a writing instrument includes an inner plug that is fitted into the shaft part and an outer plug that is coupled with the inner plug. The inner plug has a first opening through which a fluid can flow in an axial direction of the shaft part; the outer plug has a second opening through which a fluid can flow in the axial direction of the shaft part, and at least one of the first opening and the second opening are configured to be closed when the outer plug and the inner plug are coupled with each other.

3 Claims, 5 Drawing Sheets

TAIL PLUG AND WRITING INSTRUMENT

CROSS-REFERENCE TO RELATED APPLICATION

This application claims priority to Japanese Patent Application No. 2021-90372, the disclosure of which is hereby incorporated by reference in its entirety.

BACKGROUND OF THE INVENTION

Field of the Invention

The present invention relates to a tail plug to be attached to a tail end of a writing instrument and a writing instrument including the tail plug.

Description of Related Art

In general, a writing instrument having a tail plug to be provided at its tail end is sold in a state where the tail plug is attached to the writing instrument. However, a writing instrument of the type that has no ink previously filled therein to allow the user to fill ink, the writing instrument is sometimes sold in a state where the tail plug is detached. Since the tail plug is an extremely small part, accidents may occur, such as children's accidental swallowing of the tail plug, which may lead to a risk of suffocation when the throat is clogged with the tail plug. Also, a similar risk exists in a writing instrument of the type that needs to be replenished with ink from the tail end of the writing instrument with the tail plug removed therefrom.

As conventional tail plugs for the purpose of ensuring the breathing of person even in the case where the person accidentally swallows the tail plug and chokes on it, those disclosed in JP H2-58980 U, JP H10-147092 A, and JP 2000-247087 A are known.

However, in the tail plug disclosed in each of Patent Literatures 1 and 2, an end portion of the tail plug such a size as to block at least a tail end of a shaft of the writing instrument, which may cause a risk that sufficient breathing cannot be ensured when the throat is clogged with such a tail plug. On the other hand, the tail plug disclosed in Patent Literature 3 is configured be divided into a plurality of pieces to be aligned along the axial direction of the writing instrument. Thus, although the end portion of the tail plug has a smaller size, close contact between the divided pieces of the tail plug through the entire surfaces in the radial direction are required. When the close contact is insufficient, ink may leak from the tail end of the writing instrument.

SUMMARY OF THE INVENTION

It is an object of the present invention to provide a tail plug that can ensure breathing and prevent suffocation even in the case where a person accidentally swallows the tail plug and chokes on it, and a writing instrument including the tail plug.

The following presents a simplified summary of the invention disclosed herein in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The tail plug as an embodiment of the present invention is a tail plug to be attached to a tail end of a shaft part of a writing instrument, the tail plug including: an inner plug that is fitted into the shaft part: and an outer plug that is coupled with the inner plug; the inner plug having a first opening through which a fluid can flow in an axial direction of the shaft part; the outer plug having a second opening through which a fluid can flow in the axial direction of the shaft part, and at least one of the first opening and the second opening being configured to be closed when the outer plug and the inner plug are coupled with each other.

In the tail plug, preferably, the outer plug includes a closing protrusion for closing the first opening of the inner plug.

In the tail plug, preferably, the inner plug has a bottomed cylindrical shape with a bottom part and a cylindrical part, in which the bottom part has the first opening, and the closing protrusion of the outer plug extends in the axial direction of the shaft part, and a tip end portion of the closing protrusion is configured to close the first opening of the inner plug when the outer plug and the inner plug are coupled with each other.

In the tail plug, preferably, the outer plug comprises a head part that is located at a rear end of the tail plug and that has the second opening, and a fitting-in part that is fitted into the cylindrical part of the inner plug, and the fitting-in part and the closing protrusion together form therebetween a gap enabling fluid communication with the second opening.

The writing instrument as an embodiment of the present invention includes any one of the aforementioned tail plugs.

BRIEF DESCRIPTION OF DRAWINGS

The foregoing and other features of the present invention will become apparent from the following description and drawings of an illustrative embodiment of the invention in which.

DESCRIPTION OF THE INVENTION

A first embodiment of the present invention will be hereinafter described with reference to the attached drawings.

Figure 1:
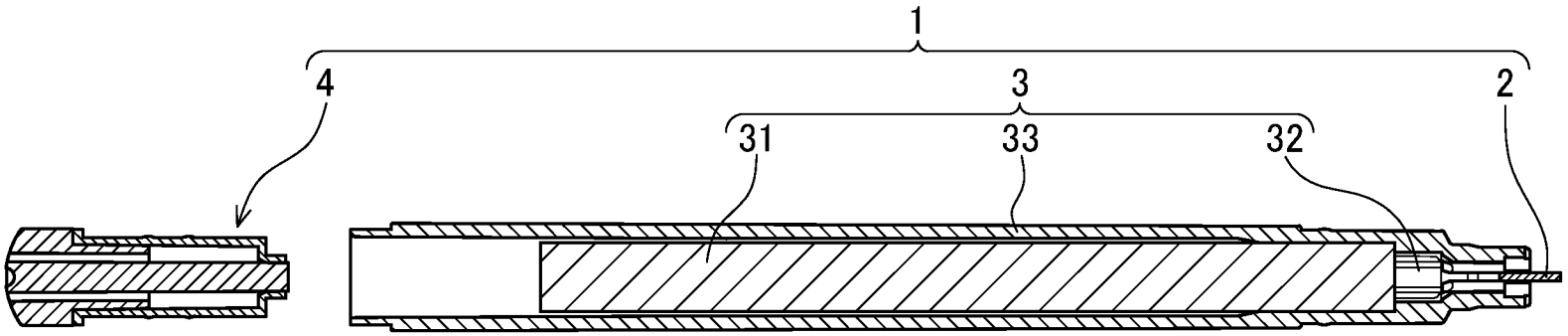
FIG. 1 is a cross section view showing a writing instrument of an embodiment.

As shown in FIG. 1, a writing instrument 1 according to this embodiment includes a pen tip part 2 for applying ink to an ink application target, a writing instrument body part 3 (hereinafter simply referred to as a body part) configured to hold the pen tip part 2 and supply ink to the pen tip part 2, and a tail plug 4 to be attached to an opposite side to the pen tip part 2 of the body part 3.

Specifically, the body part 3 includes an ink reservoir 31 that reserves ink, an ink guide part 32 that guides ink from the ink reservoir 31 to the ink tip part 2, and a shaft part 33 that has a cylindrical shape and houses the ink reservoir 31.

The tail plug 4 is fitted into a tail end of the shaft part 33 with an opening at the tail end of the shaft part 33 closed by the tail plug 4.

In this description, a direction in which the shaft part 33 extends is referred to as an axial direction, a direction orthogonal to the axial direction is referred to as a radial direction, and direction extending around the central axis of the shaft part 33 is referred to as a circumferential direction. Further, a pen tip side in the axial direction is also referred to as a tip end side, and the opposite side to the pen tip side is also referred to as a rear end side. The same expressions will be used herein for describing only the tail plug.

Figure 2:
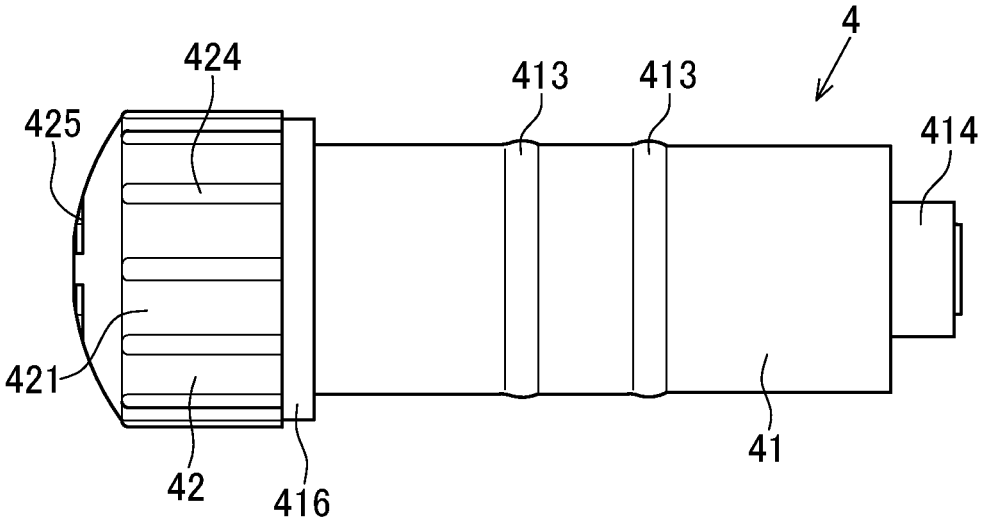
FIG. 2 is a side view showing a tail plug of an embodiment.

As shown in FIG. 2, the tail plug 4 of this embodiment includes an inner plug 41 arranged on the pen tip side of the writing instrument, and an outer plug 42 arranged on the opposite side to the pen tip side. The outer plug 42 is fitted into the inner plug 41 to be united with each other to form the tail plug 4.

Figure 4:
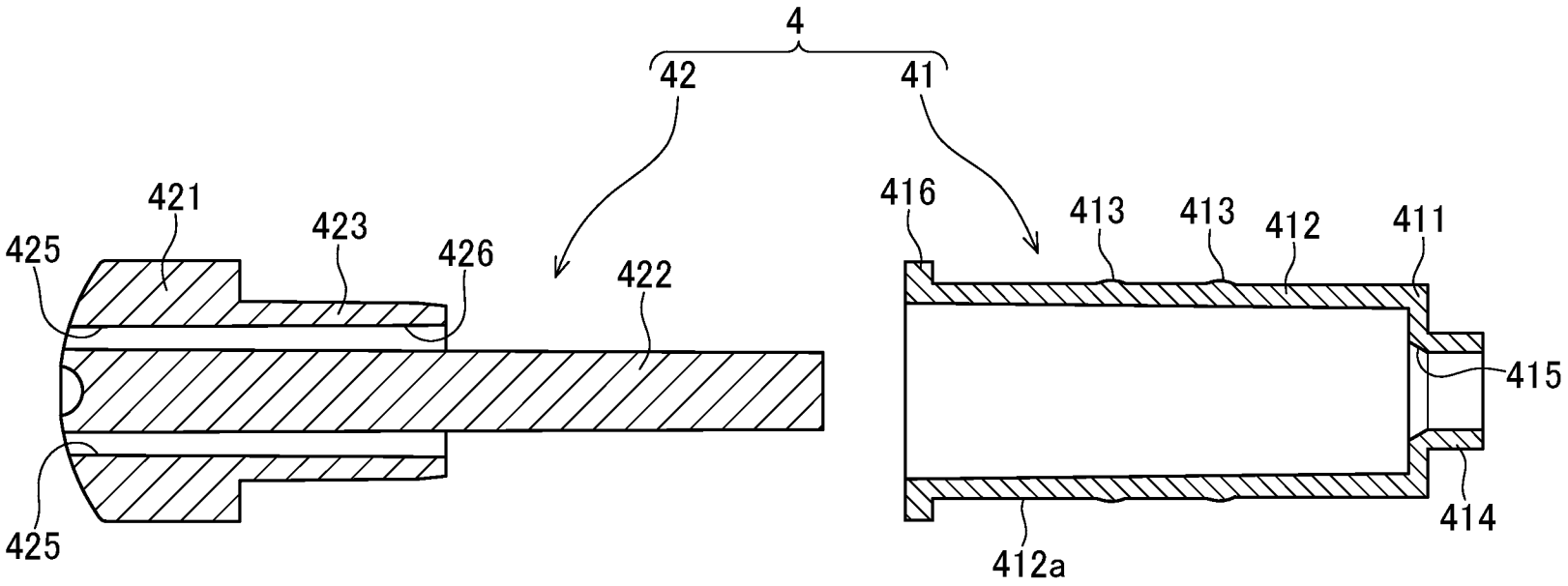
FIG. 4 is a cross section view of the tail plug taken along the line IV-IV in FIG. 3, showing an inner plug and an outer plug in a disassembled state.

As shown in FIG. 2 and FIG. 4, the inner plug 41 has a bottomed cylindrical shape with a bottom part 411 and a cylindrical part 412. The cylindrical part 412 is fitted into the shaft part 33 of the writing instrument to have their contact surfaces in a close contact state. Further, the cylindrical part 412 has an annular protrusion 413 on an outer circumferential surface 412*a* of the cylindrical part 412, and the shaft part 33 has an annular recess (not shown) on an inner circumferential surface of the shaft part 33. In this embodiment, the protrusion 413 and the recess are configured to be engaged with each other to bring the cylindrical part 412 and the shaft part 33 into locking engagement with each other.

The bottom part 411 of the inner plug 41 is located on the tip end side in the axial direction of the cylindrical part 412 and formed to extend radially inward from the cylindrical part 412. A first opening 415 through which a fluid can flow in the axial direction is formed in the central part of the bottom part 411. In this embodiment, the first opening 415 is an opening having a circular shape in radial cross section. In this embodiment, the bottom part 411 further includes an annular extension part 414 extending from the central part of the bottom part 411 toward the pen tip. The inner circumferential surface of the annular extension part 414 has the same shape in radial cross section as that of the first opening 415 of the bottom part 411, and accordingly the first opening 415 extends to the end portion on the pen tip side of the extension part 414.

Further, a flange part 416 having an annular shape and extending radially outward from the cylindrical part 412 is provided at an opposite end to the bottom part 411 in the axial direction of the inner plug 41. The flange part 416 comes into contact with the tail end of the shaft part 33 to restrict the inner plug 41 from moving toward the pen tip side, when the inner plug 41 is fitted into the shaft part 33.

On the other hand, as shown in FIG. 4, the outer plug 42 includes a head part 421 that is located on the rear end side, a closing protrusion 422 that extends from the head part 421 toward the tip end side and closes the first opening 415 of the inner plug 41, and a circumferential wall part 423 serving as a fitting-in part 423 that extends from the head part 421 toward the tip end side and is fitted into the cylindrical part 412 of the inner plug 41. The head part 421 is configured to have a diameter larger than that of the circumferential wall part 423 and comes into contact with the flange part 416 of the inner plug 41 when the outer plug 42 is fitted into the inner plug 41. That is, the head part 421 comes into contact with the flange part 416 of the inner plug 41 to thereby restrict the outer plug 42 from moving toward the pen tip side in the axial direction relative to the inner plug 41.

Figure 3:
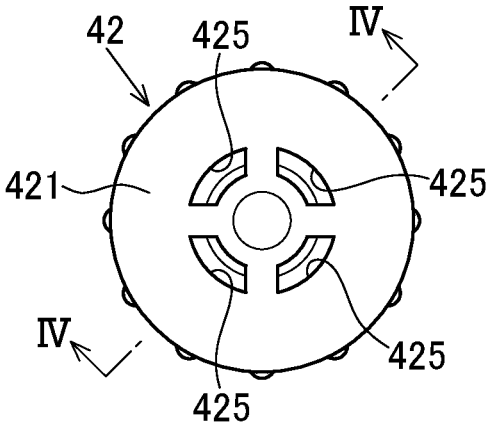
FIG. 3 is a front view showing a tail plug of an embodiment as viewed from a rear end side in an axial direction.

The head part 421 further includes a second opening 425 through which a fluid can flow in the axial direction. In this embodiment, a plurality of second openings 425 are provided at positions separated radially outward from the central axis of the outer plug 42 as shown in FIG. 3. More specifically, the head part 421 of the outer plug 42 includes four second openings 425 provided on a concentric circle with reference to the central axis at equal intervals of 90° in the circumferential direction.

Further, a plurality of ribs 424 extending in the axial direction are provided on a circumferential surface of the head part 421 (FIG. 2).

The closing protrusion 422 provided in the outer plug 42 has a tip end portion (i.e., an end portion on the pen tip side) having a cross sectional shape corresponding to that of the first opening 415 of the inner plug 41. In this embodiment, the first opening 415 has a circular shape in radial cross section, and the tip end portion of the closing protrusion 422 also has a circular shape in cross section corresponding thereto. With this configuration, when the outer plug 42 is fitted into the inner plug 41, the tip end portion of the closing protrusion 422 is fitted into the first opening 415 thereby closing the first opening 415.

The circumferential wall part 423 is configured to allow the outer circumferential surface of the circumferential wall part 423 and the inner circumferential surface of the cylindrical part 412 to come into sliding contact with each other to guide the outer plug 42 in the axial direction of the inner plug 41 when the outer plug 42 is fitted into the inner plug 41, that is, when the circumferential wall part 423 is fitted into the cylindrical part 412. The specific configuration is such that, before the tip end of the closing protrusion 422 arrives at the aperture of the first opening 415, the outer circumferential surface of the circumferential wall part 423 and the inner circumferential surface of the cylindrical part 412 come into sliding contact with each other to guide the outer plug 42 to make a positional adjustment to allow the center axis of the closing protrusion 422 to be aligned with the center of the first opening 415. Thereby, the tip end portion of the closing protrusion 422 is easily fitted into the first opening 415.

The circumferential wall part 423 has a doughnut shape in radial cross section. Further, the circumferential wall part 423 and the closing protrusion 422 are concentrically formed. Thus, an annular gap 426 is formed between the circumferential wall part 423 and the closing protrusion 422, and the annular gap extends along the axial direction. The gap 426 is in fluid communication with the second opening 425. In other words, the outer plug 42 of this embodiment is configured to allow the air to flow in the axial direction inside the circumferential wall part 423.

The writing instrument 1 of this embodiment is configured to allow the end portion on the tip end side of the inner plug 41 and the end portion on the tip end side of the outer plug 42 to press the end portion on the rear end side of the ink reservoir 31 when the tail plug 4 is fitted into the shaft part 33 of the writing instrument. More specifically, the tip end surface of the extension part 414 presses the end surface on the rear end side of the ink reservoir 31 since the inner plug 41 of this embodiment includes the annular extension part 414 extending from the bottom part 411 to the tip end side. Further, the tip end portion of the closing protrusion 422 of the outer plug 42 is configured to press the end surface on the rear end side of the ink reservoir 31 when the tip end surface of the closing protrusion 422 is fitted into the first opening 415.

Here, the ink reservoir 31 in the writing instrument 1 of this embodiment includes a cylindrical part having a cylindrical shape extending along the axial direction, and an ink absorbing part having a column shape which is housed in the cylindrical part to absorb and retain ink. The end portion on the rear end side of the ink reservoir 31 is pressed by the end portion on the tip end side of the inner plug 41 and the end portion on the tip end side of the outer plug 42 to allow the end portion on the tip end side of the ink reservoir 31 (specifically, the ink absorbing part) to be pressed to the ink guide part 32. Thus, ink reserved in the ink reservoir 31 is smoothly supplied to the pen tip part 2 via the ink guide part 32.

According to the writing instrument 1 with the above configuration, the openings through which a fluid can flow in the axial direction, that is, the first opening 415 and the second opening 425, are provided in the inner plug 41 and the outer plug 42 respectively. Thus, even in the case where an infant or the like accidentally swallows the inner plug or the outer plug, and chokes on it, air can flow in a direction along his or her airway through the opening to thereby prevent suffocation.

Further, when the inner plug 41 and the outer plug 42 are attached to the rear end of the shaft part 33 of the writing instrument 1, the tip end portion of the closing protrusion 422 of the outer plug 42 is fitted into the first opening 415 of the inner lug 41 so that the opening 415 is surely closed. Therefore, according to the tail plug 4 with the above configuration, it is possible to provide a writing instrument that is excellent in the sealing performance and less likely to leak the ink of the ink reservoir 31.

When a user replenishes ink, the user removes only the outer plug 42, while having the inner plug 41 still fitted in the shaft part 33 of the writing instrument, so that fluid can flow through the first opening 415 of the inner plug 41, which makes it possible to replenish ink from the rear end side of the writing instrument 1. In this case, the ink reservoir 31 is held in the shaft part 33 by the inner plug 41 so that the user can be prevented from contamination of his or her hands or clothes by the ink reservoir 31 jumping out from the shaft part 33.

Figure 5:
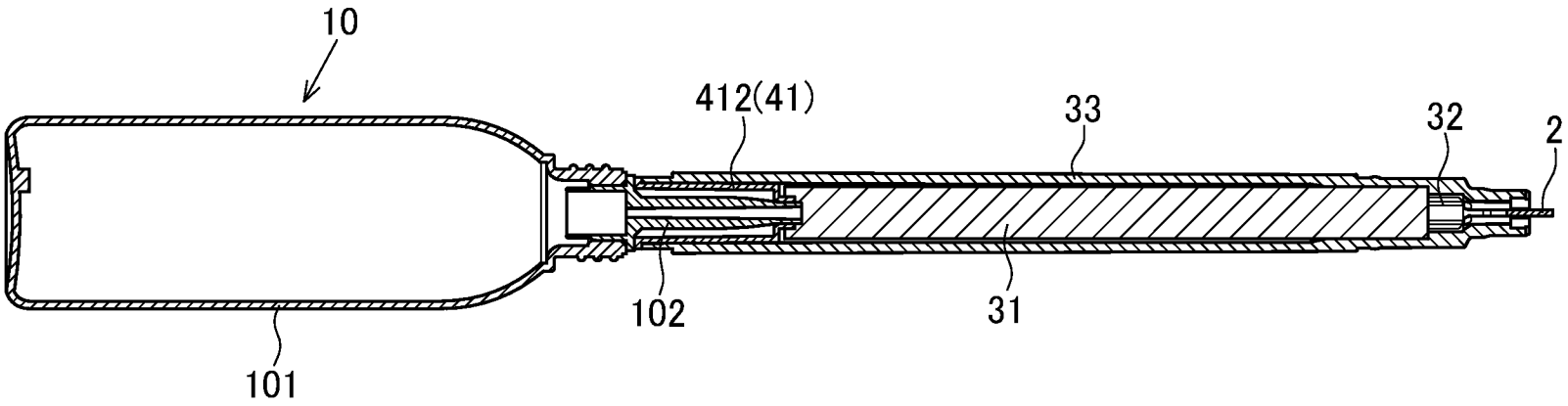
FIG. 5 is a cross section view showing a writing instrument of an embodiment in a state where it is replenished with ink from an ink replenisher.

Note that the ink replenisher 10 as shown in, for example, FIG. 5 can be used as an ink replenisher for replenishing the ink reservoir 31 with ink. The ink replenisher 10 including, for example, an ink tank 101 and a nozzle part 102 provided at a mouth of the ink tank 101 can be used. The nozzle part 102 is preferably configured to be insertable into the cylindrical part 412 of the inner plug 41. With this configuration, ink in the ink tank 101 can be supplied to the ink reservoir 31 of the writing instrument 1 via the nozzle part 102 and the inner plug 41 by removing only the outer plug 42 from the writing instrument 1 and inserting the nozzle part 102 of the ink replenisher 10 into the cylindrical part 412 of the inner plug 41. Further, an ink replenisher which can be used herein is the ink replenisher 10 as shown in FIG. 5, which has the tip end portion of the nozzle part 102 inserted into the first opening 415 of the inner plug 41 and comes into contact with the ink reservoir 31. In this case, the tip end of the nozzle part 102 is held and stabilized by the first opening 415 of the inner plug 41, to produce an effect of enabling easy ink replenishment.

As described above, the tail plug 4 in the writing instrument 1 of this embodiment is a tale plug 4 to be attached to a tail end of a shaft part of a writing instrument 1, the tail plug 4 including an inner plug 41 that is fitted into the shaft part 33, and an outer plug 42 that is coupled with the inner plug 41, the inner plug 41 having a first opening 415 through which a fluid can flow in an axial direction of the shaft part 33, the outer plug 42 having a second opening 425 through which a fluid can flow in the axial direction of the shaft part 33, and at least one of the first opening 415 and the second opening 425 being configured to be closed when the outer plug 42 and the inner plug 41 are coupled with each other.

According to the tail plug 4 with the above configuration, each of the inner plug 41 and the outer plug 42 has the opening (the first opening 415, the second opening 425) through which a fluid can flow in the axial direction of a shaft. Thus, even in the case where a person accidentally swallows the inner plug 41 or the outer plug 42 and chokes on it, the opening ensures air flowing in the axial direction to thereby avoid suffocation.

Further, the outer plug 42 in the tail plug 4 can include the closing protrusion 422 for closing the first opening 415 of the inner plug 41.

With this configuration, the first opening 415 of the inner plug 41 is closed by the closing protrusion 422 of the outer plug 42, and thus the sealing performance of the writing instrument 1 when used can be enhanced.

The tail plug 4 can be configured such that the inner plug 41 has a bottomed cylindrical shape with a bottom part 411 and a cylindrical part 412, the bottom part 411 has the first opening 415, the closing protrusion 422 of the outer plug 42 extends in the axial direction of the shaft part 33, and a tip end portion of the closing protrusion 422 is configured to close the first opening 415 of the inner plug 41 when the outer plug 42 and the inner plug 41 are coupled with each other.

According to the tail plug 4 with the above configuration, ink is sealed at the bottom part 411 of the inner plug 41 so as not to flow between the inner plug 41 and the outer plug 42. Thus, even when the outer plug 42 is removed from the inner plug 41, the user's hands can be prevented from being stained with ink.

Further, the tail plug 4 can be configured such that the outer plug 42 includes a head part 421 that is located at a rear end of the tail plug 4 and has the second opening 425, and a fitting-in part 423 that is fitted into the cylindrical part 412 of the inner plug 41, and the fitting-in part 423 and the closing protrusion 422 together form therebetween a gap 426 enabling fluid communication with the second opening 425.

According to the tail plug 4 with the above configuration, the gap 426 formed between the fitting-in part 423 and the closing protrusion 422 enabling fluid communication with the second opening 425 can more reliably secure his or her airway when the tail plug 4 is accidentally swallowed.

The writing instrument 1 of this embodiment can include any one of the aforementioned tail plugs 4.

According to the writing instrument 1 with the above configuration, it is possible to prevent a person from accidentally swallowing the tale plug 4 and choking on it when the tail plug 4 is removed from the writing instrument 1.

Next, the tail plug of another embodiment (hereinafter referred to as the second embodiment) will be described. It can be configured such that the tail plug of the second embodiment includes an inner plug and an outer plug, the inner plug includes a closing protrusion, and a second opening provided in the outer plug is closed by the closing protrusion provided.

Specifically, the inner plug in the second embodiment has a bottomed cylindrical shape with a bottom part and a cylindrical part. The bottom part is located at the pen tip side end in the axial direction of the cylindrical part and formed to extend radially inward from the cylindrical part. The closing protrusion is formed at the center of the bottom part to extend in the axial direction toward the opposite side to the pen tip part, that is, toward the rear end side. That is, in the second embodiment, the closing protrusion is provided not in the outer plug but in the inner plug, and the closing protrusion extends in the opposite direction to that of the previously-described embodiment. Further, the first opening through which a fluid can flow in the axial direction is formed between the cylindrical part and the closing protrusion in the bottom part. A plurality of first openings can be formed at intervals, for example, in the circumferential direction.

Further, a flange part having an annular shape and extending radially outward from the cylindrical part is provided at an opposite end to the bottom part in the axial direction of the inner plug. When the inner plug is fitted into the shaft part, the flange part comes into contact with the tail end of the shaft part to restrict the inner plug from moving toward the pen tip side.

On the other hand, the outer plug in the second embodiment includes a head part, and a circumferential wall part that extends from the head part toward the tip end side and is fitted into the cylindrical part of the inner plug. It can be configured such that the head part has a diameter larger than that of the circumferential wall part and comes into contact with the flange part of the inner plug when the head part is fitted into the inner plug. That is, the head part comes into contact with the flange part of the inner plug 41 to thereby restrict the outer plug from moving toward the pen tip side relative to the inner plug.

The head part further includes a second opening through which a fluid can flow in the axial direction. A second opening is provided at the center of the head part in the outer plug of the second embodiment. More specifically, the second opening having a circular shape in radial cross section is provided at the center of the head part.

The closing protrusion formed in the inner plug has a tip end portion (that is, the end portion on the opposite side to the pen tip part) having a cross sectional shape corresponding to that of the second opening. The second opening has a circular shape in radial cross section, while the tip end portion of the closing protrusion has a circular shape in cross section. Thereby, when the outer plug is fitted into the inner plug, the tip end portion of the closing protrusion is fitted into the second opening to thereby close the second opening.

Similarly to the previously-described embodiment, the circumferential wall part is configured to allow the outer circumferential surface of the circumferential wall part and the inner circumferential surface of the cylindrical part to come into sliding contact with each other to guide the outer plug in the axial direction when the circumferential wall part is fitted into the cylindrical part of the inner plug. Thereby, when the outer plug is fitted into the inner plug, the outer circumferential surface of the circumferential wall part first comes into sliding contact with the inner circumferential surface of the cylindrical part to guide the outer plug so as to align the central axes of the outer plug and the inner plug with each other. In addition, the outer plug is pushed into the innermost part of the inner plug, to allow the tip end portion of the closing protrusion to be easily fitted into the second opening.

Also in the tail plug of the second embodiment with the above configuration, the opening through which a fluid can flow in the axial direction is provided in each of the inner plug and the outer plug. Thus, even in the case where a person accidentally swallows and chokes on it, air flow in the direction along his or her airway is secured to produce an effect of preventing suffocation.

The tail plug and the writing instrument according to the present invention are not limited to the above embodiment, and it is matter of course that various modifications can be made without departing from the gist of the present invention. Also, the functional effect of the present invention is not limited to the aforementioned embodiment. That is, the embodiments disclosed herein should be assumed as not limitations but exemplifications in all aspects. The scope of the present invention is described not by the above description but by the claims. Further, the scope of the present invention is intended to include the scope equivalent to the claims and all the changes in the claims.

For example, the tail plug of the above embodiment was described by taking, for example, the case where the tail plug is composed of two members, that is, the inner plug and the outer plug. However, the present invention is not limited to this configuration, and either one or both of the inner plug or/and the outer plug can be composed of a plurality of members to form a tail plug composed of three or more members as a whole.

Adopted in the above embodiment is the configuration in which the closing protrusion is fitted into the first opening or the second opening to close the first opening or the second opening. However, the present invention is not limited to this configuration. It can be configured such that when the inner plug and the outer plug have been coupled with each other, a part of the inner plug or the outer plug closes the first opening or the second opening on the opponent member.

In the above embodiment, the description was made on the case where each of the first opening and the tip end portion of the closing protrusion has a circular shape in cross section. However, the present invention is not limited to this configuration and any shape can be adopted.

Adopted in the above embodiment was the configuration in which the circumferential wall part is provided in the outer plug to allow the outer circumferential surface of the circumferential wall part and the inner circumferential surface of the cylindrical part to come into sliding contact with each other. However, the present invention is not limited to this configuration. For example, the rib extending radially outward from the closing protrusion of the outer plug in the first embodiment can include a plurality of ribs formed in a radial manner from the closing protrusion to allow the tip ends of the ribs to come into sliding contact with the inner circumferential surface of the cylindrical part of the inner plug.

What is claimed is:

1. A tail plug to be attached to a tail end of a shaft part of a writing instrument, the tail plug comprising:

an inner plug that is fitted into the shaft part: and an outer plug that is coupled with the inner plug;

the inner plug having a first opening through which a fluid can flow in an axial direction of the shaft part;

the outer plug having a second opening through which a fluid can flow in the axial direction of the shaft part, at least one of the first opening and the second opening being configured to be closed when the outer plug and the inner plug are coupled with each other, wherein the outer plug comprises a closing protrusion for closing the first opening of the inner plug, the inner plug has a bottomed cylindrical shape with a bottom part and a cylindrical part, in which the bottom part has the first opening, and the closing protrusion of the outer plug extends in the axial direction of the shaft part, a tip end portion of the closing protrusion is configured to close the first opening of the inner plug when the outer plug and the inner plug are coupled with each other, the outer plug comprises a head part that is located at a rear end of the tail plug and that has the second opening, and a circumferential wall part that is fitted into the cylindrical part of the inner plug, and the circumferential wall part and the closing protrusion together form therebetween a gap enabling fluid communication with the second opening.

2. A tail plug to be attached to a tail end of a shaft part of a writing instrument, the shaft part comprising an ink reservoir that reserves an ink, the tail plug comprising:

an inner plug that is fitted into the shaft part; and an outer plug that is coupled with the inner plug;

the inner plug having a first opening through which a fluid can flow in an axial direction of the shaft part;

the outer plug having a second opening through which a fluid can flow in the axial direction of the shaft part, wherein the first opening is closed with the outer plug or the second opening is closed with the inner plug, when the outer plug and the inner plug are coupled with each other, the outer plug is removable from the inner plug with the inner plug being inserted into the shaft part, and the first opening serves as an ink supply port to the ink reservoir with the outer plug being removed from the inner plug.

3. The tail plug according to claim 2, wherein the inner plug has a bottomed cylindrical shape with a cylindrical part and a bottom part located on a tip end side in the axial direction of the cylindrical part, the bottom part has the first opening, and the outer plug comprises a closing protrusion for closing the first opening when the outer plug and the inner plug are coupled with each other.

* * * * *